US009032882B1

(12) United States Patent
Richardson

(10) Patent No.: US 9,032,882 B1
(45) Date of Patent: May 19, 2015

(54) TABLE CLEANING IMPLEMENT

(71) Applicant: Rich L. Richardson, Katy, TX (US)

(72) Inventor: Rich L. Richardson, Katy, TX (US)

( * ) Notice: Subject to any disclaimer, the term of this patent is extended or adjusted under 35 U.S.C. 154(b) by 0 days.

(21) Appl. No.: 13/913,314

(22) Filed: Jun. 7, 2013

(51) Int. Cl.
*A47B 85/00* (2006.01)
*A47B 13/00* (2006.01)

(52) U.S. Cl.
CPC ..... *A47B 13/00* (2013.01)

(58) Field of Classification Search
CPC ..... A47B 13/16; A47D 1/008; A47L 13/51; A47L 13/52
USPC ..... 108/25, 26, 152, 69; 312/280, 281, 282; 15/257.01, 257.1, 257.9; 220/910, 911, 220/908.3; 206/216; 248/230.6; 211/90.01; 297/182, 188.2, 153
See application file for complete search history.

(56) References Cited

U.S. PATENT DOCUMENTS

| | | | | | |
|---|---|---|---|---|---|
| 581,681 | A * | 4/1897 | Shauer | 108/26 |
| 1,888,127 | A * | 11/1932 | Hearne | 248/207 |
| 2,090,176 | A * | 8/1937 | Besancon | 248/231.81 |
| 2,707,141 | A * | 4/1955 | Witter | 108/26 |
| 2,920,757 | A * | 1/1960 | Garman | 206/806 |
| 3,536,285 | A * | 10/1970 | James | 248/309.4 |
| 3,828,389 | A * | 8/1974 | Heisler | 15/257.06 |
| 4,099,470 | A * | 7/1978 | Cannon, Jr. | 108/26 |
| 4,164,299 | A * | 8/1979 | Fuhr | 15/257.06 |
| 4,802,595 | A * | 2/1989 | Northington | 108/26 |
| 4,961,556 | A * | 10/1990 | Sosa | 248/314 |
| 5,294,194 | A * | 3/1994 | Lombardo | 312/229 |
| 5,996,983 | A * | 12/1999 | Laurenzi | 269/15 |
| 6,058,851 | A * | 5/2000 | Alexander et al. | 108/25 |
| 7,011,363 | B1 * | 3/2006 | Connery | 297/153 |
| 7,578,234 | B2 * | 8/2009 | Sumner | 99/537 |
| D642,349 | S * | 7/2011 | Palmer | D32/54 |
| 8,015,927 | B1 | 9/2011 | Helline | |
| 8,113,127 | B2 | 2/2012 | Helline | |
| 8,584,888 | B2 * | 11/2013 | Buerk | 220/482 |
| 2004/0120607 | A1 * | 6/2004 | Goren | 383/22 |
| 2004/0206761 | A1 * | 10/2004 | Frantz | 220/570 |
| 2005/0279749 | A1 * | 12/2005 | Karrasch et al. | 220/503 |
| 2011/0232536 | A1 | 9/2011 | Morevec et al. | |

* cited by examiner

*Primary Examiner* — Jose V Chen
(74) *Attorney, Agent, or Firm* — Kenneth A. Roddy

(57) ABSTRACT

A hand-held table cleaning implement has upstanding rear and laterally opposed side walls, a handle on the backside of the rear wall, a flat horizontal platform extending a distance forwardly from the side walls for insertion beneath a table top, an intermediate portion adjoined to bottom ends of the rear and side walls and back end of the platform defining a central opening tapering downwardly and inwardly therefrom, and a trash receptacle extending downwardly from the intermediate portion for receiving trash, refuse, crumbs, and debris swept or scraped from the table top surface. A generally rectangular scraper may be provided that can be clipped onto a flat surface of the table cleaning implement, and removed therefrom for use in scraping and sweeping debris, crumbs, and food remnants from the table top and into the receptacle. The implement can be hooked over an edge of another object, and is easily stored.

5 Claims, 3 Drawing Sheets

TABLE CLEANING IMPLEMENT

BACKGROUND OF THE INVENTION

1. Field of the Invention

This invention relates generally to cleaning implements and, more particularly, to a hand-held table cleaning implement having a flat horizontal platform portion with upstanding rear and laterally opposed side walls, a front portion extending forwardly therefrom for insertion beneath a table top, and a trash receptacle extending downwardly from the platform for receiving trash, refuse, crumbs, and debris swept or scraped from the table surface.

2. Background Art

It is important for restaurants, cafeterias, and other dining establishments to minimize the amount of time that each table is unoccupied, especially during certain busy periods, such as lunch periods, dinner periods and weekend evenings. Thus, there is a heavy burden on restaurant personnel, including the waitresses, and the "busser" (busboy or busgirl), to make sure that no table remains unoccupied any longer than absolutely necessary due to cleaning and resetting the table, known as "bussing". Inefficiency in accomplishing the table cleaning and resetting or bussing task results in longer waiting periods for customers, and can cause dissatisfaction of waiting customers. Fast, efficient, and thorough bussing, cleaning and resetting of tables increases the number of times a table can be occupied by new parties and, thus, the profitability of the restaurant.

Typically in a bussing operation, generally rectangular bus tubs, also known as dish tubs, are used to stack dirty dishes, and in most cases, everything that is on the table and needs to be washed is placed into the tub. The bus tub is placed on a chair or cart, and the table is cleared by placing dirty dishes, into the bus tub. A wet rag is used to wipe liquid spills and sweep the accumulation of debris, crumbs, and food remnants (pieces of vegetables, etc.), to the edge of the table surface and into a suitable receptacle, typically onto a serving tray or into the bus tub. The table is then wiped down and items needed for the next customers are replaced. Although care may be taken by the busser, crumbs and debris may fall onto the chair seats and surrounding area, and time is consumed by having to sweep the loor and surrounding area.

There are several patents directed toward various cleaning trays designed to facilitate the cleaning of a table top.

Helline, U.S. Pat. No. 8,015,927, discloses a cleaning tray for removably engaging a table outer edge which has a parallelepiped main body having two internal wedges therein, a removable receptacle for receiving trash centered in the main body, and a rectangular compartment attached to a rear side of the main body for holding cleaning supplies.

Helline, U.S. Pat. No. 8,113,127, discloses a cleaning tray for the improved cleaning of surfaces which is engageable with a plurality of different shaped horizontal surfaces, and allows the horizontal surface to overhang at least a portion of a collecting portion, with detritus swept from the horizontal surface into the collecting portion, and then into a waste container.

Moravec et al, Published U.S. Patent Application 2011/0232536, discloses a multi-functional apparatus for aiding cleaning of edged surfaces, such as a countertop or tabletop that is mountable on the edge portion thereof. In a first embodiment, the apparatus has a first assembly which is mounted to the edge portion using clamps and includes an elongated tray with at least one bracket for mounting a second assembly thereon. The second assembly includes an elongated gutter and mounting portions attached thereto. The tray slopes downward from its rear edge to its front edge. The gutter is located below and parallel to the front edge of the tray. The first assembly may include a compressible strip attached to the rear edge of the tray, so that the strip is pressed against the underside of the edge portion when the apparatus is mounted. In a second embodiment, a frame holding a disposable bag is used instead of the gutter.

SUMMARY OF THE INVENTION

The present invention overcomes the aforementioned problems and is distinguished over the prior art in general, and these patents in particular by a hand-held table cleaning implement having a three-sided upper portion formed of an upstanding rear wall and adjoined upstanding lateral side walls that extend forwardly from the rear wall. Each lateral side wall has a horizontal top end portion that extends forwardly a distance from the rear wall, a diagonal portion that extends angularly downward and forward therefrom and terminates in a vertical front end. A generally rectangular horizontal platform extends transversely between the bottoms of the front ends of the lateral side walls and a distance forwardly therefrom and terminates in a front end. The table cleaning implement has an intermediate wall portion that extends downwardly and tapers inwardly from the upper portion and adjoins an open upper end of a tub or receptacle having a bottom wall, which forms the bottom portion of the table cleaning implement.

An outwardly curved handle defining a handgrip portion is disposed on the back side of the upstanding rear wall and has a depending vertical bottom portion disposed a short distance outwardly from the backside of the table cleaning implement. The depending vertical bottom portion has an aperture therethrough. The depending vertical bottom portion of the handle may be hooked over the edge of a bus tub, tray or cart or other object for storing or transporting the table cleaning implement. The aperture of the depending vertical bottom portion may also be placed on a hook for conveniently storing the table cleaning implement when not being used.

A generally rectangular scraper may also be provided for use with the table cleaning implement. The scraper has a thin bottom edge and a rounded top end that extends longitudinally along the scraper and has a short clip portion that extends a short distance downwardly from the rounded top end and angularly inward toward one side of the scraper. The scraper may be removably clipped onto a flat surface of the table cleaning implement in a stored condition, and removed therefrom for use in cleaning a table.

In use, the present table cleaning implement is held by one-hand gripping the handgrip portion of the curved handle and the front end of the horizontal platform is placed beneath a table top and pushed forwardly until the front ends of the upstanding lateral side walls engage the edge of the table. Using the scraper, the user may then sweep debris, crumbs, and food remnants to the edge of the table and into the tub or receptacle. The scraper may also be used to dislodge and remove stuck-on food items, such as hardened ketchup and syrup, as well as gum stuck underneath the table. It can also be used to clean up beverage and other liquid spills. The table cleaning implement may be stored or transported by hooking the depending vertical bottom portion of the handle over the edge of a bus tub, tray or cart or other object. It may also be stored when not in use by placing the aperture of the depending vertical bottom portion of the handle on a hook.

One of the significant features and advantages of the present table cleaning implement is that it will reduce the time the amount of time that a table remains unoccupied due to cleaning and resetting the table.

Another feature and advantage of the present table cleaning implement is that it will allow rapid, efficient, and thorough bussing, cleaning and resetting of tables.

Another feature and advantage of the present table cleaning implement is that it will reduce the time spent cleaning the floor, chairs, and surrounding area, of crumbs and debris using a broom and sweeper.

Another feature and advantage of the present table cleaning implement is that it is constructed of lightweight materials and can be easily handled with one hand, is hand washable, dishwasher safe, and can be easily stored or hung when not in use.

Another feature and advantage of the present table cleaning implement is that it is can be used in restaurants, cafeterias, and dining establishments, as well as in homes, in airplanes and tour buses, sports stadiums, amusement parks, churches, and outdoor events.

Still further features and advantages of the present table cleaning implement is that it is simple in construction, inexpensive to manufacture, and rugged and reliable in use.

Other features and advantages of the invention will become apparent from time to time throughout the specification and claims as hereinafter related.

DESCRIPTION OF THE PREFERRED EMBODIMENT

Figure 1:
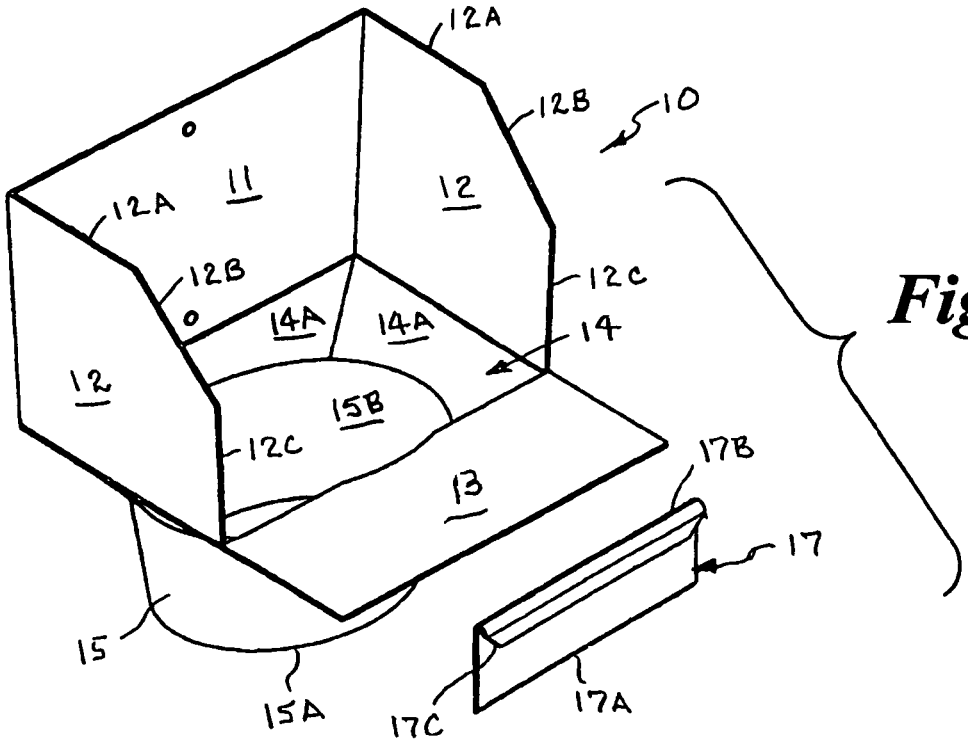
FIG. 1 is a perspective view of the table cleaning implement in accordance with the present invention, as seen from the top, front and one side.
Figure 2:
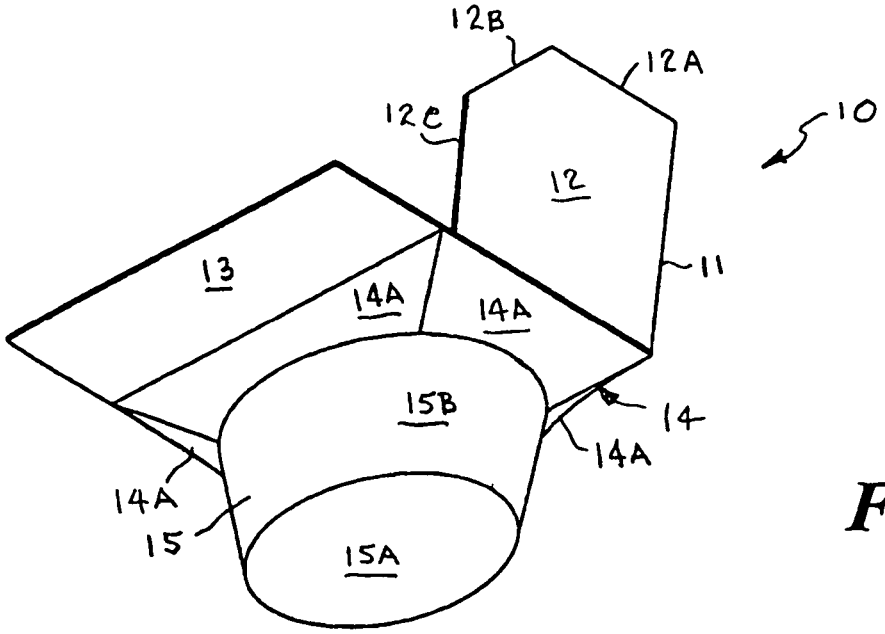
FIG. 2 is a perspective view of the table cleaning implement, as seen from the bottom and side opposite that shown in FIG. 1.
Figure 4:
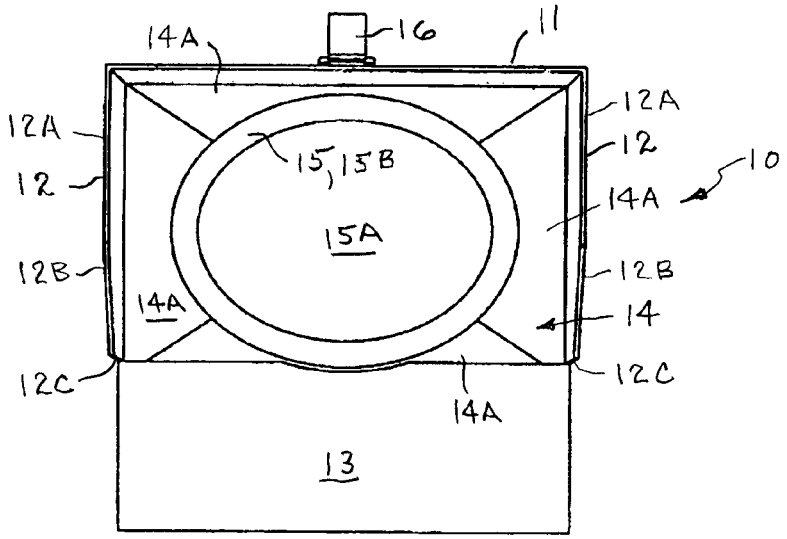
FIG. 4 is a top plan view of the table cleaning implement.
Figure 3:
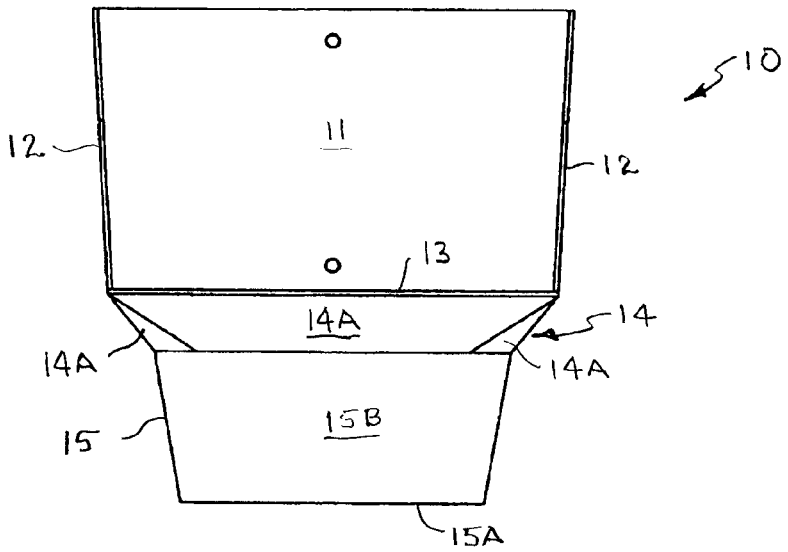
FIG. 3 is a front elevation view of the table cleaning implement.
Figure 5:
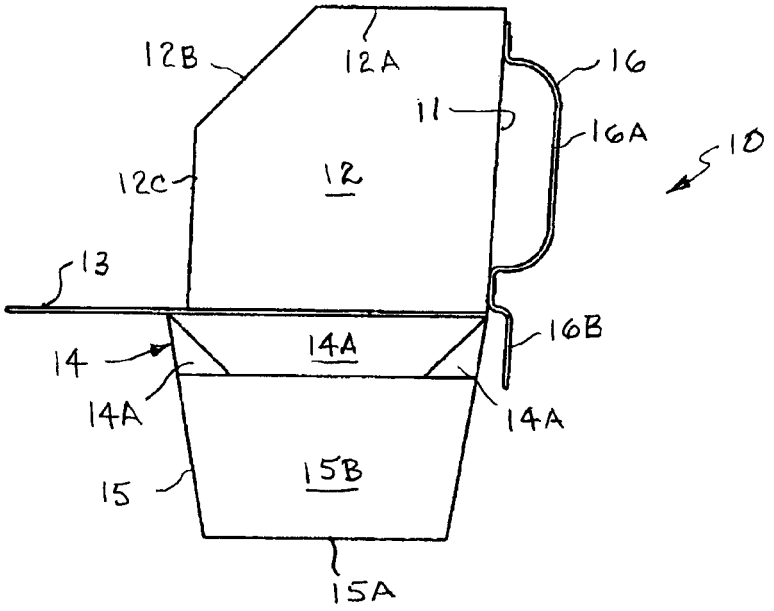
FIG. 5 is a side elevation of the table cleaning implement, the opposite side being a mirror image thereof.
Figure 6:
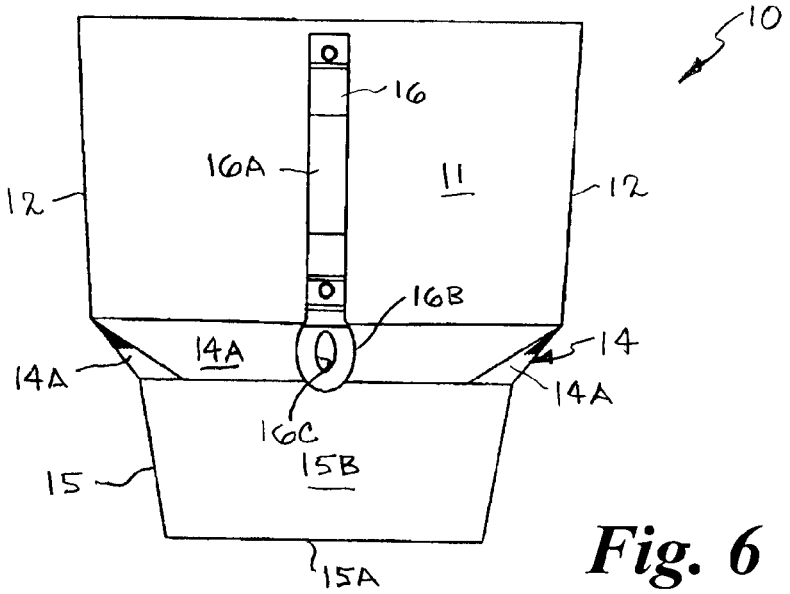
FIG. 6 is a rear elevation view of the table cleaning implement.

Referring to the drawings by numerals of reference, there is shown in FIGS. 1-6, a preferred table cleaning implement 10 formed of a rigid material such as molded plastic or metal. The table cleaning implement 10 has a three-sided upper portion formed of an upstanding rear wall 11 and adjoined upstanding lateral side walls 12 that extend forwardly from the rear wall 11. Each lateral side wall 12 has a horizontal top end portion 12A that extends forwardly a distance from the rear wall 11, a diagonal portion 12B that extends angularly downward and forward therefrom and terminates in a vertical front end 12C.

A flat planar generally rectangular horizontal platform 13 extends transversely between the bottoms of the front ends 12C of the lateral side walls 12 and a distance forwardly therefrom and terminates in a front end.

The table cleaning implement 10 has an intermediate portion 14 that extends downwardly and inwardly from the upper portion. In the illustrated example, the intermediate portion 14 is shown to be formed of intermediate walls 14A that are adjoined at upper ends to the bottoms of the rear wall 11, lateral side walls 12, and rear wall 11, and the back end of the horizontal platform 13, respectively, and taper downwardly and inwardly therefrom.

A tub or receptacle 15 having a bottom wall 15A, an upstanding side wall 15B, and an open top end 15C is adjoined at its open top end to the lower ends of the intermediate walls 14A and forms the bottom portion of the table cleaning implement 10. In the illustrated example, the tub or receptacle 15 is shown to have a generally oval-shaped transverse cross section.

It should be understood that, the configurations of the intermediate portion 14 and the tub or receptacle 15 are shown for purposes of example only and not limited thereto, and that they may be configured differently. For example, the intermediate portion 14 may be formed of a single truncated generally conical intermediate wall 14A having a larger diameter upper portion adjoined to the back end portion of the platform 13 and the bottoms of the rear wall 11, and lateral side walls 12, and a smaller lower end adjoined to the tub or receptacle 15. It should also be understood, that the tub or receptacle 15 may have a circular or square transverse cross section.

An outwardly curved handle 16 defining a handgrip portion 16A is secured to the back side of the upstanding rear wall 11 in a generally vertical orientation, and has an inverted generally L-shaped hook portion 16B disposed beneath the handgrip portion. The hook portion 16B has a horizontal leg extending a short distance outwardly from the backside of the table cleaning implement 10 and an adjoined depending vertical leg extending downwardly therefrom. The depending vertical leg of the hook portion 16B has an aperture 16C therethrough. The generally L-shaped hook portion 16B is configured to receive and be hooked over an upward facing edge of a bus tub, tray or cart or other object for storing or transporting the table cleaning implement 10 thereon. The aperture 16C of the depending vertical leg of the hook portion 16B is configured to receive a hook or projection, such as a nail, for supporting and conveniently storing the table cleaning implement thereon when not being used.

As seen in FIG. 1, a scraper 17 may also be provided for use with the table cleaning implement 10. The scraper 17 is a generally rectangular member having a thin longitudinal bottom edge 17A and a rounded top end 17B that extends longitudinally along the scraper and has a short extension or clip portion 17C that extends a short distance downwardly from the rounded top end and angularly inward toward one side of the scraper. The clip portion 17C of the scraper 17 is configured to receive and removably engage a flat surface of the table cleaning implement. Thus, the clip portion 17C allows the scraper 17 to be removably clipped onto a flat surface of the table cleaning implement 10 in a stored condition, and removed therefrom by the user for use in cleaning a table, as described hereinafter.

In a preferred embodiment, but not limited thereto, the upstanding rear wall 11 may be about 12" in width and about 7½" tall. The lateral side walls 12 may extend about 7½" forwardly from the rear wall 11, with their horizontal top end portions 13A extending about 4½" forwardly from the rear wall 11 and their front ends 12C having a height of about 4½" with their diagonal portions 12B extending therebetween. The generally rectangular horizontal platform 13 may have a width of about 12" between the lateral sides and terminate a distance of about 7¼" outwardly from the front ends 12C of the lateral side walls 12 for insertion beneath a table top.

In use, the present table cleaning implement 10 is held by one-hand gripping the handgrip portion 16A of the curved handle 16 and the front end of the horizontal platform 13 is placed beneath a table top and pushed forwardly until the front ends 12C of the upstanding lateral side walls 12 engage the edge of the table. Using the scraper 17, the user may then sweep debris, crumbs, and food remnants to the edge of the table and into the tub or receptacle 17. The scraper 17 may also be used to dislodge and remove stuck-on food items, such as hardened ketchup and syrup, as well as gum stuck underneath the table. It can also be used to clean up beverage and other liquid spills. When properly positioned, there are no gaps between the table and the table cleaning implement unit, allowing debris and liquid to go directly into the tub or receptacle as the table is cleaned.

The table cleaning implement 10 may be stored or transported by hooking the depending vertical bottom portion 16B of the handle 16 over the edge of a bus tub, tray or cart or other object. It may also be stored when not in use by placing the aperture 16C of the depending vertical bottom portion 16B of the handle 16 on a hook.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A hand-held table cleaning implement for use in cleaning a dining table of debris, crumbs, and food remnants, comprising:

a three-sided upper wall portion formed of an upstanding rear wall and adjoined upstanding lateral side walls that extend forwardly a distance from said rear wall and terminate in respective vertical front ends;

a generally rectangular flat planar horizontal front platform adjoined to and extending transversely between bottom ends of said front ends of said lateral side walls and a distance forwardly therefrom terminating in a front end;

an intermediate wall portion adjoined to bottom ends of said rear wall, said lateral side walls, and a back end of said horizontal front platform tapering downwardly and inwardly therefrom and terminating in a central opening;

a receptacle having an open upper end adjoined to a lower end of said intermediate wall portion central opening and extending a distance downwardly therefrom and terminating in an enclosed bottom end, said receptacle forming a bottom portion of said table cleaning implement; and an outwardly curved handle secured to a back side of said upstanding rear wall in a generally vertical orientation having an outwardly curved upper portion defining a handgrip portion for gripping and holding the table cleaning implement in an upright position;

in use, said table cleaning implement is held in an upright position by a user gripping said handgrip portion with one hand, said front end of said flat planar horizontal front platform is placed beneath a table top and pushed forwardly until said vertical front ends of said lateral side walls of said upper wall portion engage a peripheral edge of the table top, and with the user's the other hand, debris, crumbs, and food remnants are scraped or swept to the edge of the table top and into said receptacle.

2. The hand-held table cleaning implement according to claim 1, wherein each of said upstanding lateral side walls of said upper wall portion has a horizontal top end portion that extends forwardly a distance from said rear wall, a diagonal portion that extends angularly downward and forward therefrom and terminates in said vertical front end.

3. A hand-held table cleaning implement for use in cleaning a dining table of debris, crumbs, and food remnants, comprising:

a three-sided upper wall portion formed of an upstanding rear wall and adjoined upstanding lateral side walls that extend forwardly a distance from said rear wall and terminate in respective vertical front ends;

a generally rectangular flat planar horizontal front platform adjoined to and extending transversely between bottom ends of said front ends of said lateral side walls and a distance forwardly therefrom terminating in a front end;

an intermediate wall portion adjoined to bottom ends of said rear wall, said lateral side walls, and a back end of said horizontal front platform tapering downwardly and inwardly therefrom and terminating in a central opening;

a receptacle having an open upper end adjoined to a lower end of said intermediate wall portion central opening and extending a distance downwardly therefrom and terminating in an enclosed bottom end, said receptacle forming a bottom portion of said table cleaning implement; and an outwardly curved handle secured to a back side of said upstanding rear wall in a generally vertical orientation having an outwardly curved upper portion defining a handgrip portion for gripping and holding the table cleaning implement in an upright position;

said outwardly curved handle having a depending inverted generally L-shaped hook portion disposed beneath said handgrip portion with a horizontal leg extending a short distance outwardly from said back side of said table cleaning implement and an adjoined depending vertical leg extending downwardly therefrom configured to be received over an upstanding edge of a bus tub, tray or cart or other object for supporting and storing said table cleaning implement thereon;

in use, said table cleaning implement is held in an upright position by a user gripping said handgrip portion with one hand, said front end of said flat planar horizontal front platform is placed beneath a table top and pushed forwardly until said vertical front ends of said lateral side walls of said upper wall portion engage a peripheral edge of the table top, and with the user's the other hand, debris, crumbs, and food remnants are scraped or swept to the edge of the table top and into said receptacle.

4. The hand-held table cleaning implement according to claim 3, wherein said depending vertical leg of said hook portion has an aperture therethrough configured to be received on a hook or projection for supporting and storing said table cleaning implement thereon.

5. A hand-held table cleaning implement for use in cleaning a dining table of debris, crumbs, and food remnants, comprising:

a three-sided upper wall portion formed of an upstanding rear wall and adjoined upstanding lateral side walls that extend forwardly a distance from said rear wall and terminate in respective vertical front ends;

a generally rectangular flat planar horizontal front platform adjoined to and extending transversely between bottom ends of said front ends of said lateral side walls and a distance forwardly therefrom terminating in a front end;

an intermediate wall portion adjoined to bottom ends of said rear wall, said lateral side walls, and a back end of said horizontal front platform tapering downwardly and inwardly therefrom and terminating in a central opening;

a receptacle having an open upper end adjoined to a lower end of said intermediate wall portion central opening and extending a distance downwardly therefrom and terminating in an enclosed bottom end, said receptacle forming a bottom portion of said table cleaning implement;

an outwardly curved handle secured to a back side of said upstanding rear wall in a generally vertical orientation having an outwardly curved upper portion defining a handgrip portion for gripping and holding the table cleaning implement in an upright position; and a generally rectangular scraper for use with said table cleaning implement, said scraper having a thin longitudinal bottom edge and a longitudinally extending rounded top end with a short lip extending a distance downwardly from said rounded top end and angularly inward toward one side of said scraper defining a clip portion configured to receive and removably engage a flat surface of said table cleaning implement to support said scraper thereon in a stored condition, and said scraper removed therefrom by a user for use in scraping and sweeping debris, crumbs, and food remnants from the table top and into said receptacle;

in use, said table cleaning implement is held in an upright position by the user gripping said handgrip portion with one hand, said front end of said flat planar horizontal front platform is placed beneath a table top and pushed forwardly until said vertical front ends of said lateral side walls of said upper wall portion engage a peripheral edge of the table top, said scraper is gripped by the user's other hand, and debris, crumbs, and food remnants are scraped or swept to the edge of the table top and into said receptacle.

* * * * *